US011040852B2

(12) United States Patent
Dube

(10) Patent No.: US 11,040,852 B2
(45) Date of Patent: Jun. 22, 2021

(54) ELEVATOR CAR CONTROL TO ADDRESS ABNORMAL PASSENGER BEHAVIOR

(71) Applicant: OTIS ELEVATOR COMPANY, Farmington, CT (US)

(72) Inventor: Randall S. Dube, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 552 days.

(21) Appl. No.: 15/967,785

(22) Filed: May 1, 2018

(65) Prior Publication Data

US 2019/0337759 A1 Nov. 7, 2019

(51) Int. Cl.

| | |
|---|---|
| ***B66B 5/00*** | (2006.01) |
| ***B66B 1/30*** | (2006.01) |
| ***B66B 1/32*** | (2006.01) |
| ***B66B 3/00*** | (2006.01) |
| ***B66B 5/04*** | (2006.01) |
| ***B66B 9/00*** | (2006.01) |

(52) U.S. Cl.

CPC ..... *B66B 5/0012* (2013.01); *B66B 1/30* (2013.01); *B66B 1/32* (2013.01); *B66B 3/002* (2013.01); *B66B 5/044* (2013.01); *B66B 9/00* (2013.01); *B66B 2201/00* (2013.01)

(58) Field of Classification Search

CPC ..... B66B 5/0012; B66B 1/30; B66B 1/32; B66B 3/002; B66B 5/044; B66B 9/00; B66B 2201/00; B66B 5/025; B66B 5/02

See application file for complete search history.

(56) References Cited

U.S. PATENT DOCUMENTS

| | | | |
|---|---|---|---|
| 1,950,150 | A | 3/1934 | Norton et al. |
| 3,315,767 | A | 4/1967 | Walter |
| 3,638,762 | A | 2/1972 | Johns |
| 4,094,385 | A | 6/1978 | Maeda et al. |
| 4,457,405 | A | 7/1984 | Johns |
| 4,923,055 | A | 5/1990 | Holland |
| 5,538,106 | A | 7/1996 | McHugh et al. |
| 5,651,427 | A | 7/1997 | Kulak et al. |

(Continued)

FOREIGN PATENT DOCUMENTS

| | | | |
|---|---|---|---|
| CN | 201610675 | U | 10/2010 |
| CN | 204057608 | U | 12/2014 |

(Continued)

OTHER PUBLICATIONS

Extended European Search Report for Application No. EP 19 17 2084 dated Mar. 8, 2020.

(Continued)

*Primary Examiner* — Jeffrey Donels

(74) *Attorney, Agent, or Firm* — Carlson, Gaskey & Olds

(57) ABSTRACT

An illustrative example elevator system includes an elevator car, a machine that selectively causes movement of the elevator car, and a drive that controls the machine to control movement of the elevator car at an intended elevator car speed. The drive is configured to use information regarding operation of the machine to determine whether an abnormal passenger behavior (APB) condition exists that affects movement of the elevator car. The drive is configured to alter the elevator car speed when the APB condition exists.

28 Claims, 4 Drawing Sheets

(56) References Cited

U.S. PATENT DOCUMENTS

| | | | |
|---|---|---|---|
| 5,651,428 | A | 7/1997 | Ahigian et al. |
| 5,718,055 | A | 2/1998 | Pierce et al. |
| 5,732,796 | A | 3/1998 | Ahigian et al. |
| 5,959,266 | A | 9/1999 | Uchiumi |
| 6,089,355 | A | 7/2000 | Seki et al. |
| 6,173,813 | B1 | 1/2001 | Rebillard et al. |
| 6,446,759 | B1 | 9/2002 | Kulak et al. |
| 6,474,448 | B1 | 11/2002 | Zappa |
| 7,147,084 | B2 | 12/2006 | Jahkonen |
| 7,252,179 | B2 | 8/2007 | Oberleitner |
| 7,350,623 | B2 | 4/2008 | Kinoshita et al. |
| 7,398,862 | B2 | 7/2008 | Dziwak |
| 7,650,971 | B2 | 1/2010 | Pillin et al. |
| 8,939,262 | B2 | 1/2015 | Schienda et al. |
| 9,260,275 | B2 | 2/2016 | Reuter et al. |
| 9,302,886 | B2 | 4/2016 | Tantis et al. |
| 9,637,350 | B2 | 5/2017 | Mittermayr |
| 9,656,835 | B2 | 5/2017 | Kitazawa |
| 9,663,329 | B2 | 5/2017 | Zappa |
| 9,834,413 | B2 | 12/2017 | Mittermayr |
| 9,845,224 | B2 | 12/2017 | Rasanen et al. |
| 10,196,237 | B2 * | 2/2019 | Kattainen ..... B66B 5/02 |
| 2001/0003319 | A1 | 6/2001 | Itoh et al. |
| 2012/0000729 | A1 | 1/2012 | Marvin et al. |
| 2012/0000732 | A1 | 1/2012 | Draper et al. |
| 2016/0145074 | A1 * | 5/2016 | Kattainen ..... B66B 1/285 187/254 |
| 2017/0190547 | A1 | 7/2017 | Dharmaraj |
| 2018/0079621 | A1 | 3/2018 | Fauconnet et al. |
| 2018/0118514 | A1 | 5/2018 | Bruno |
| 2018/0229972 | A1 | 8/2018 | Kulak et al. |
| 2018/0265334 | A1 | 9/2018 | Kulak et al. |
| 2019/0337765 | A1 | 11/2019 | Wang et al. |
| 2019/0337767 | A1 | 11/2019 | Tracey et al. |
| 2019/0337768 | A1 | 11/2019 | Kulak et al. |
| 2019/0337769 | A1 | 11/2019 | Khzouz et al. |
| 2020/0115192 | A1 | 4/2020 | Montigny et al. |

FOREIGN PATENT DOCUMENTS

| | | | |
|---|---|---|---|
| CN | 204369335 | U | 6/2015 |
| CN | 103693538 | B | 7/2015 |
| CN | 104773637 | A | 7/2015 |
| CN | 103693539 | B | 11/2015 |
| CN | 103803389 | B | 11/2015 |
| CN | 104176604 | B | 3/2016 |
| CN | 104444734 | B | 3/2016 |
| CN | 105645239 | A | 6/2016 |
| CN | 105936467 | A | 9/2016 |
| CN | 106006324 | A | 10/2016 |
| CN | 106044504 | A | 10/2016 |
| CN | 106081819 | A | 11/2016 |
| CN | 106081820 | A | 11/2016 |
| CN | 106395582 | A | 2/2017 |
| CN | 107176530 | A | 9/2017 |
| CN | 107614412 | A | 1/2018 |
| EP | 2426076 | A1 | 3/2012 |
| EP | 3048075 | B1 | 3/2018 |
| GB | 415931 | | 9/1934 |
| GB | 2358623 | A | 8/2001 |
| JP | H0812228 | | 1/1996 |
| JP | H10203742 | A | 8/1998 |
| JP | 2005008371 | * | 1/2005 |
| JP | WO2011104818 | * | 9/2011 |
| JP | 2005008371 | | 1/2013 |
| WO | 2005/077808 | A2 | 8/2005 |
| WO | 2006/080094 | A1 | 8/2006 |
| WO | 2011/104818 | A1 | 9/2011 |
| WO | 2011/137545 | A1 | 11/2011 |
| WO | 2014/122358 | A1 | 8/2014 |
| WO | 2016/085678 | A1 | 6/2016 |
| WO | 2016/176033 | A1 | 11/2016 |
| WO | 2017/023927 | A1 | 2/2017 |
| WO | 2017/187560 | A1 | 11/2017 |

OTHER PUBLICATIONS

Extended European Search Report for Application No. EP 19 17 2026 dated Sep. 5, 2019.

Extended European Search Report for Application No. EP 19 17 2105 dated Sep. 27, 2019.

Extended European Search Report for Application No. EP 19 17 2040 dated Sep. 23, 2019.

The Extended European Search Report for EP Application No. 19172106.7, dated Jan. 31, 2020.

* cited by examiner

ELEVATOR CAR CONTROL TO ADDRESS ABNORMAL PASSENGER BEHAVIOR

BACKGROUND

Elevators have proven useful for carrying passengers between different floors in buildings. Various types of elevator systems are known.

The configuration of some low-to-midrise, light weight elevators may allow for a natural or resonant frequency associated with the system rise, moving masses, suspension termination stiffness, and the roping that supports the elevator car. In some such systems, it is possible for a passenger in the elevator car to bounce or jump in a manner that induces vertical oscillations of the elevator car. When those oscillations are at or near the natural frequency of the system, the elevator car may bounce sufficiently to activate the over speed governor resulting in an emergency stop of the elevator car. Stopping the car this way interferes with the availability of the elevator car to provide service to other passengers. Additionally, such stops often require a mechanic to visit the site to allow passengers to exit the car, to reset the governor overspeed switch and may require the safeties to be reset before placing the elevator car back into service.

SUMMARY

An illustrative example elevator system includes an elevator car, a machine that selectively causes movement of the elevator car, and drive electronics that control the machine to control movement of the elevator car at an intended elevator car speed. The drive electronics are configured to use information regarding operation of the machine to determine whether an abnormal passenger behavior (APB) condition exists that affects movement of the elevator car. The drive electronics are configured to alter the elevator car speed when the APB condition exists.

In an example embodiment having one or more features of the elevator system of the previous paragraph, the information regarding operation of the machine comprises information regarding an electrical current of the machine.

An example embodiment having one or more features of the elevator system of any of the previous paragraphs includes an inverter associated with at least one of the drive and the machine and the information regarding the electrical current of the machine comprises a difference between an expected electrical current and an actual electrical current associated with the inverter.

In an example embodiment having one or more features of the elevator system of any of the previous paragraphs, the difference between the expected electrical current and the actual electrical current comprises a difference in at least one of a frequency of the current, an amplitude of the current, and periodic transient current peaks.

An example embodiment having one or more features of the elevator system of any of the previous paragraphs includes at least one sensor that provides an indication of a speed of movement of the elevator car and the information regarding operation of the machine comprises an output of the at least one sensor.

In an example embodiment having one or more features of the elevator system of any of the previous paragraphs, the at least one sensor comprises an encoder associated with the machine.

In an example embodiment having one or more features of the elevator system of any of the previous paragraphs, the drive is configured to use the output of the at least one sensor to determine whether the APB condition exists and the drive is configured to use the output of the at least one sensor to control operation of the machine to achieve the intended elevator car speed when the APB condition does not exist.

In an example embodiment having one or more features of the elevator system of any of the previous paragraphs, the APB condition includes passenger movement of at least a portion of a body of at least one passenger in the elevator car that causes oscillations of the elevator car in a vertical direction and the passenger movement comprises at least one of bouncing or jumping.

In an example embodiment having one or more features of the elevator system of any of the previous paragraphs, the APB condition affects movement of the elevator car by at least temporarily causing the elevator car to move at an increased speed that exceeds the intended elevator car speed and the drive is configured to alter the elevator car speed by reducing the elevator car speed below the intended elevator car speed.

In an example embodiment having one or more features of the elevator system of any of the previous paragraphs, the drive is configured to reduce the elevator car speed by reducing the elevator car speed by a first amount from the intended elevator car speed and if the APB condition affects movement of the elevator car after reducing the elevator car speed by the first amount, reduce the elevator car speed further by a second amount.

An example embodiment having one or more features of the elevator system of any of the previous paragraphs includes a governor that is configured to instigate stopping the elevator car if the elevator car moves at a speed that exceeds a preselected threshold. The drive is configured to determine when the APB condition includes causing the elevator car to move at a speed that approaches the preselected threshold and reduce the elevator car speed before the APB condition includes causing the elevator car to move at a speed that reaches or exceeds the preselected threshold.

An example embodiment having one or more features of the elevator system of any of the previous paragraphs includes a governor that is configured to instigate stopping the elevator car if the elevator car moves at a speed that exceeds a preselected threshold. The governor includes a centrifugal mechanism that moves in a manner that instigates stopping the elevator car, the APB is effective to cause movement of the centrifugal mechanism in the manner that instigates stopping the elevator car even though the elevator car speed does not exceed the preselected threshold, and the drive is configured to alter the speed of the elevator car to prevent the movement of the centrifugal mechanism from instigating stopping the elevator car.

An example embodiment having one or more features of the elevator system of any of the previous paragraphs includes an indicator in the elevator car. The indicator is configured to provide at least one of an indication that the elevator car is moving at less than the intended elevator speed, an indication to stop the APB, an indication that authorities will be notified of the APB, and an indication that continuing the APB could result in being trapped in the elevator car.

An example embodiment having one or more features of the elevator system of any of the previous paragraphs includes a camera in the elevator car and wherein the camera captures at least one image of any passenger in the elevator car during the APB.

An illustrative example method of controlling movement of an elevator car includes controlling a machine to control movement of the elevator car at an intended elevator car speed, determining whether an abnormal passenger behavior (APB) condition exists that affects movement of the elevator car, based upon information regarding operation of the machine, and altering the elevator car speed when the APB condition exists.

In an example embodiment having one or more features of the method of the previous paragraph, the information regarding operation of the machine comprises information regarding an electrical current of the machine.

In an example embodiment having one or more features of the method of any of the previous paragraphs, the information regarding the electrical current of the machine comprises a difference between an expected electrical current and an actual electrical current associated with an inverter associated with the machine.

In an example embodiment having one or more features of the method of any of the previous paragraphs, the difference between the expected electrical current and the actual electrical current comprises a difference in at least one of a frequency of the current, an amplitude of the current, and periodic transient current peaks.

An example embodiment having one or more features of the method of any of the previous paragraphs includes determining the information regarding operation of the machine based on an output of at least one sensor that provides an indication of a speed of movement of the elevator car.

In an example embodiment having one or more features of the method of any of the previous paragraphs, the APB condition includes passenger movement of at least a portion of a body of at least one passenger in the elevator car that causes oscillations of the elevator car in a vertical direction and the passenger movement comprises at least one of bouncing or jumping.

In an example embodiment having one or more features of the method of any of the previous paragraphs, the APB condition affects movement of the elevator car by at least temporarily causing the elevator car to move at an increased speed that exceeds the intended elevator car speed and the method comprises altering the elevator car speed by reducing the elevator car speed below the intended elevator car speed.

In an example embodiment having one or more features of the method of any of the previous paragraphs, reducing the elevator car speed comprises reducing the elevator car speed by a first amount from the intended elevator car speed and if the APB condition affects movement of the elevator car after reducing the elevator car speed by the first amount, reducing the elevator car speed further by a second amount.

An example embodiment having one or more features of the method of any of the previous paragraphs includes determining when the APB condition includes causing the elevator car to move at a speed that approaches a preselected threshold of a governor that is configured to instigate stopping the elevator car if the elevator car moves at a speed that exceeds the preselected threshold and reducing the elevator car speed before the APB condition includes causing the elevator car to move at a speed that reaches or exceeds the preselected threshold.

In an example embodiment having one or more features of the method of any of the previous paragraphs, the APB is effective to cause movement of a centrifugal mechanism of a governor in the manner that instigates stopping the elevator car even though the elevator car speed does not exceed a preselected threshold of the governor and the method comprises altering the speed of the elevator car to prevent the movement of the centrifugal mechanism from instigating stopping the elevator car.

An example embodiment having one or more features of the method of any of the previous paragraphs includes providing at least one of an indication that the elevator car is moving at less than the intended elevator speed, an indication to stop the APB, an indication that authorities will be notified of the APB, and an indication that continuing the APB could result in being trapped in the elevator car.

An example embodiment having one or more features of the method of any of the previous paragraphs includes obtaining at least one image of any passenger in the elevator car during the APB.

The various features and advantages of at least one disclosed example embodiment will become apparent to those skilled in the art from the following detailed description. The drawings that accompany the detailed description can be briefly described as follows.

DETAILED DESCRIPTION

Embodiments of this invention provide the ability to address potential issues introduced by abnormal passenger behavior (APB) conditions. Example embodiments include controlling movement of an elevator car in a manner that prevents an emergency stop of the elevator car that otherwise could result from an APB condition.

Figure 1:
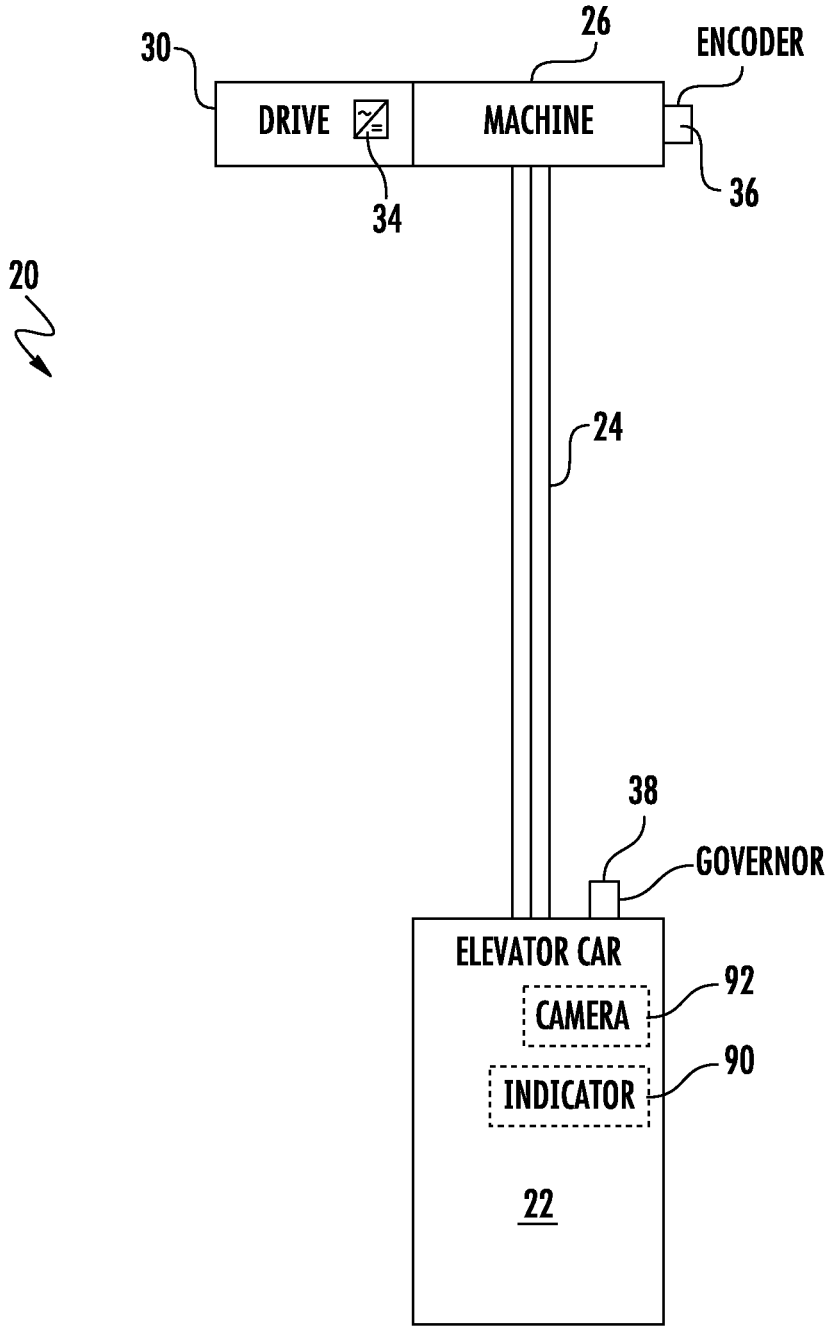
FIG. 1 schematically illustrates selected portions of an elevator system designed according to an embodiment of this invention.

FIG. 1 schematically illustrates selected features of an example embodiment of an elevator system 20. An elevator car is supported by roping 24, which may comprise flat belts. A machine 26 includes a motor and brake that control movement of the roping 24 to achieve desired movement of the elevator car 22.

An elevator drive 30 controls operation of the machine 26 so that the elevator car 22 moves as needed to provide the elevator service requested by passengers. The drive 30 is schematically shown for discussion purposes. The drive 30 includes drive electronics that control the power provided to the machine 26, for example. At least one inverter 34 serves as an interface between a power source and the machine 26.

Under normal operating conditions the drive 30 uses information regarding operation of the machine to control movement of the elevator car in a generally known manner. Such information includes current associated with the inverter 34. The illustrated example includes a sensor 36 that provides an output that is indicative of a speed or position of the elevator car 22. The illustrated example includes an encoder that is part of the machine 26 as the sensor 36. The encoder output is used by the drive 30 in some examples as information regarding operation of the machine 26 for purposes of controlling elevator car movement.

The example elevator system 20 includes a governor 38 that operates in a known manner to instigate stopping the elevator car 22 if an overspeed condition occurs. The governor 38 may be located on the elevator car 22 as shown in FIG. 1 or it may be situated in the hoistway or in a machine room. For example, the governor 38 may include a centrifugal mechanism that responds to a speed of the elevator car 22 to operate an overspeed switch that instigates an emergency stop of the elevator car 22. The governor 38 may include a centrifugal mechanism with springs that control flyweights that move radially outward in response to increasing rotational governor speed correlated with the speed of the elevator car 22. There are known relationships between elevator car speed and the rotational speed of the centrifugal mechanism. The centrifugal mechanism of the governor 38 operates based on movement of the elevator car 22 and, therefore, the mechanism may have operational sensitivities to APB that affect movement of the elevator car 22.

Figure 2:
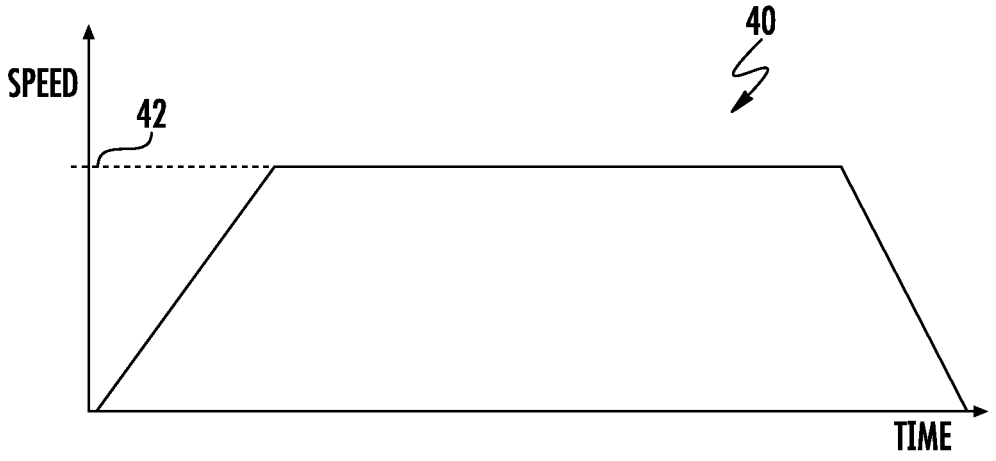
FIG. 2 illustrates an example elevator car motion profile during normal operating conditions.

FIG. 2 illustrates an example motion profile 40. The drive 30 causes the machine 26 to accelerate the elevator car 22 until it reaches an intended elevator car speed 42, which may be referred to as a contract speed. As the elevator car 22 approaches a scheduled landing the drive 30 causes the machine 26 to operate to decelerate the elevator car 22 and bring it to a stop at the end of the run.

Figure 3:
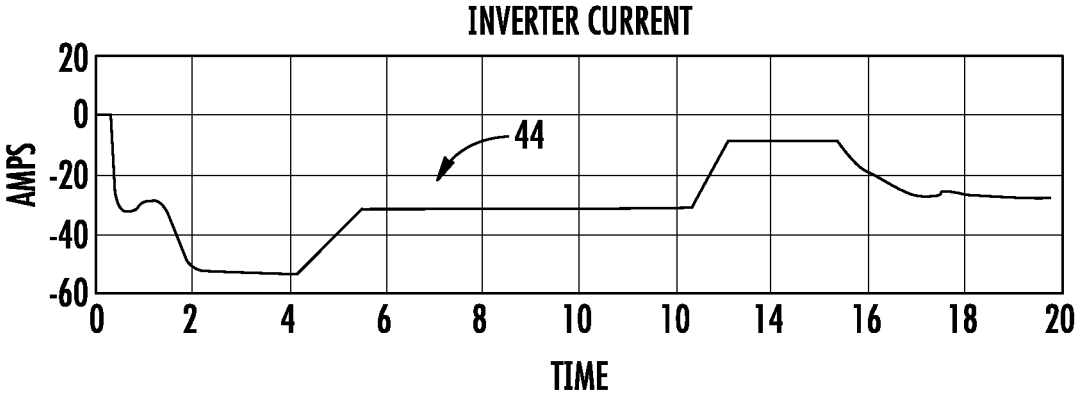
FIG. 3 illustrates a current associated with operation of an elevator machine during normal operating conditions.

During a run that includes normal operation, current associated with the inverter 36 has an expected pattern over the course of the run. An example expected current trace 44 is shown in FIG. 3. The drive 30 is capable of recognizing when the current follows this pattern and determining when the current of the inverter 36 deviates from the expected or normal pattern. An APB condition may cause the current pattern to vary from the expected pattern.

It is possible for an APB condition to exist when at least one passenger in the elevator car 22 rhythmically bounces or jumps, causing the elevator car 22 to bounce or oscillate vertically. Such car motion caused by the APB can result in the governor 38 instigating an emergency stop of the elevator car 22 in at least one of two ways. One of those ways includes causing temporary elevator car speeds that exceed the speed threshold of the governor 38. The other way includes causing movement of the flyweights of the governor centrifugal mechanism that triggers and emergency stop even if the elevator car speed does not exceed the governor's speed threshold speed.

Figure 4:
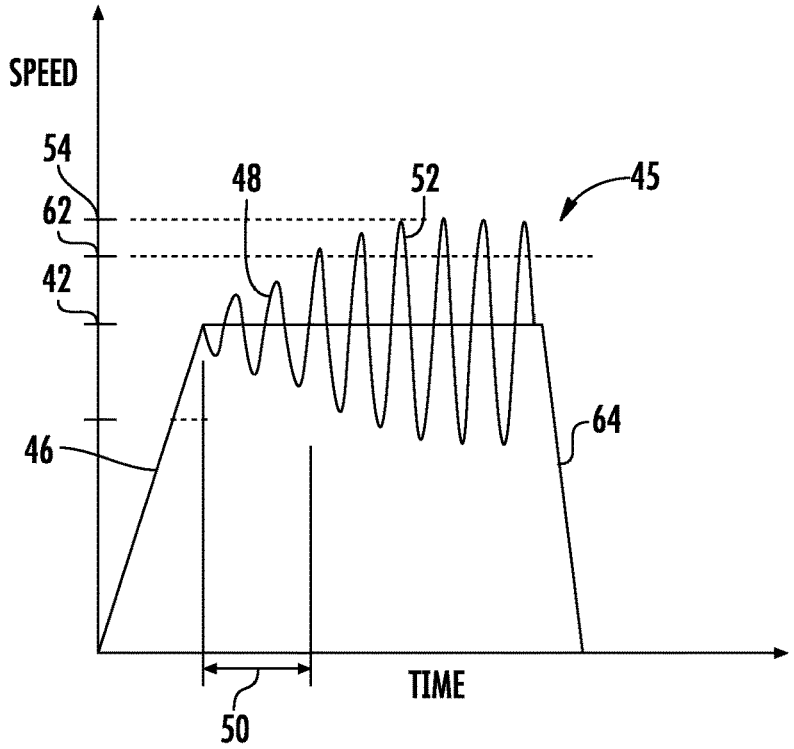
FIG. 4 illustrates an example elevator car motion profile during an abnormal passenger behavior (APB) condition.

FIG. 4 illustrates an example motion profile 45 that includes car movement affected by APB. The drive 30 causes the machine 26 to operate so that the elevator car 22 accelerates at 46 until the elevator car 22 reaches the intended elevator car speed 42. A passenger bouncing or jumping within the elevator car 22 causes it to bounce, introducing changes in the car speed as shown at 48. The APB condition during the constant speed portion of the motion profile will typically include the most significant effect on the car speed. The duration of acceleration at 46, for example, is typically short enough that a passenger's behavior will not introduce APB conditions that require attention.

If an APB condition like that at 48 exists for a period of time, such as that illustrated at 50, it is possible to induce bouncing or oscillations of the elevator car 22 at or near the system natural frequency leading to increasing amplitude oscillations as shown at 52. One negative consequence of such oscillations is that the speed of movement of the elevator car 22 may exceed the intended elevator car speed 42 as shown at 54.

The governor 38 has a preselected threshold speed shown at 62 in FIG. 4. When the elevator car 22 moves at a speed that exceeds the threshold speed 62, the governor 38 instigates an emergency stop. As shown in FIG. 4, because the elevator car speed at 54 exceeds the preselected threshold speed 62 of the governor 38, an emergency stop condition brings the elevator car to a stop after decelerating at 64. Such a stop is undesirable because it interferes with the scheduled run and may remove the elevator car 22 from service until a mechanic is able to come to the site to allow any trapped passengers to exit the elevator car 22 and return the elevator car 22 to its normal operation. The slope at 64 is steeper than that associated with a normal elevator stop at the end of a run that follows an intended motion profile that is uninterrupted by any APB (as shown in FIG. 2, for example).

Even if the speed of the elevator car 22 does not exceed the governor threshold 62, some APB conditions may result in an undesirable emergency stop. It is possible for the elevator car 22 to bounce because of the APB and for the bouncing frequency to overlap with the natural frequency of the elevator system. When such overlap is coupled with the response sensitivity of the centrifugal mechanism of the governor 38 having a similar inherent natural frequency the flyweights of the centrifugal mechanism may bounce radially outward in response to the APB. When such bouncing continues the radially outward movement of the flyweights will increase until the flyweights move sufficiently to actuate the overspeed switch instigating an emergency stop.

The drive 30 is configured to determine when an APB condition exists that affects the movement of the elevator car 22 like that represented in FIG. 4 or described in the preceding paragraph. The drive 30 is configured to alter the movement of the elevator car 22 to avoid negative consequences of the APB condition. In the illustrated example, the drive 30 is configured to reduce a speed of movement of the elevator car 22 below the intended elevator car speed 42 so that the oscillations caused by the APB will not result in the speed of the elevator car 22 exceeding the preselected threshold speed 62 of the governor 38 or the governor's centrifugal mechanism flyweights moving radially outward sufficiently to impact the overspeed switch.

Figure 5:
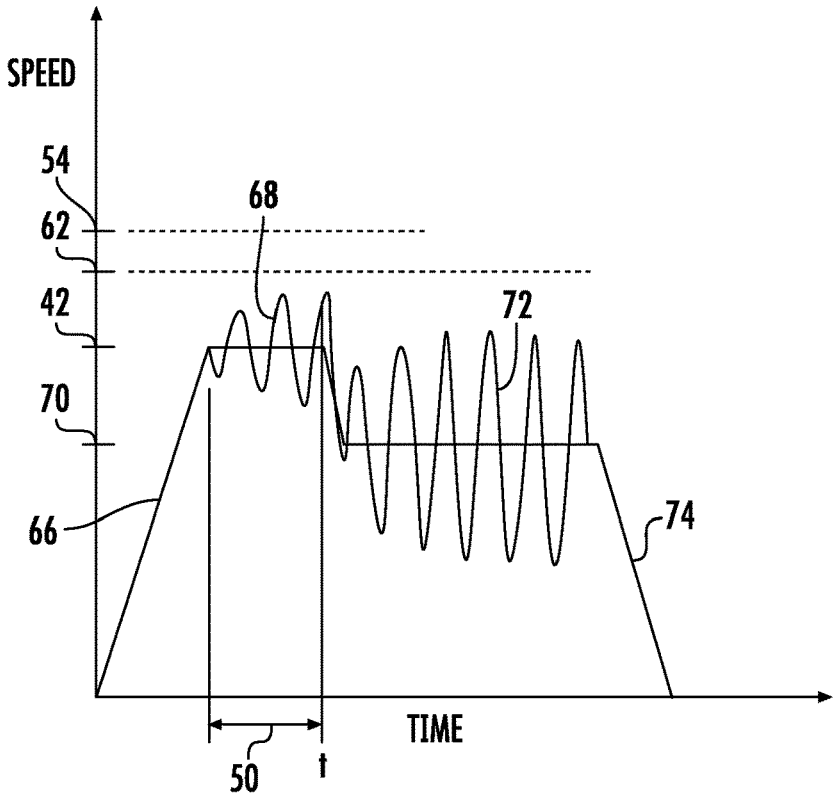
FIG. 5 illustrates another example elevator car motion profile during an APB condition including altered elevator car movement.

FIG. 5 illustrates an example technique of altering the speed of movement of the elevator car 22 in response to an APB condition. The elevator car 22 accelerates at 66 until it reaches the intended elevator car speed 42. A passenger jumps or bounces within the elevator car 22 causing an APB condition including oscillations of the elevator car as shown at 68. The drive 30 determines that the APB condition exists and at time t alters a speed of movement of the elevator car 22 by reducing the elevator car speed from the intended speed at 42 to a lower elevator car speed at 70. With the elevator car 22 moving at the lower speed at 70, even if the oscillations at 72 have an amplitude similar to that shown at 52 in FIG. 4, the overall elevator car speed reaches a maximum well below the threshold speed 62 of the governor 38. The reduced speed 70 remains in effect until the end of the current run when the elevator car decelerates at 74 to come to a scheduled stop at a landing or when the drive 30 determines that the machine 26 operation corresponds to an expected behavior when the reduced speed is not required. The drive 30 is configured to utilize the intended elevator car speed 42 for any subsequent elevator runs unless another APB condition arises.

In the illustrated example, the drive 30 reduces the elevator car speed by approximately 10% of the contract speed or intended elevator car speed 42. For example, when the intended or contract speed is one meter per second, the drive 30 reduces that speed by 0.1 meters per second during an APB condition. For elevator car speed of 2 meters per second or 1.5 meters per second, a speed reduction of 0.1 meters per second or 0.2 meters per second, for example, is effective to avoid adverse consequences associated with the APB condition. Such a reduction in speed of the elevator car is typically not noticeable by passengers in the elevator car 22 but is enough to prevent the governor from reacting when not desired. In some embodiments, the speed reduction may be greater than or less than 10%. In some embodiments, rather than a specific percentage reduction, the speed reduction may be a certain velocity such as 0.5 meters per second. In one embodiment, the speed reduction may be greater than or less than 0.5 meters per second.

In the illustrated example, a single change in elevator car speed is effective to address the APB situation. In some embodiments the drive 30 reduces the car speed in steps or stages. For example, the drive reduces the car speed by a first amount, such as 5%, and continues to monitor if the APB has potential to interfere with normal operation. If the APB condition does not subside or worsens, the drive 30 further reduces the car speed by a second, larger amount, such as 10%. One feature of this approach is that it allows for smaller decreases in car speed to alleviate concerns associated with APB under some circumstances.

Altering movement of the elevator car 22 by slowing it down will also address an APB situation that induces bouncing of the centrifugal mechanism flyweights of the governor 38 even if the overall car speed would not exceed the threshold 62. Such APB-induced bouncing in the governor's centrifugal mechanism depends in part on the speed of the elevator car and a reduced speed is effective to reduce the extent of radially outward movement of the flyweights so they do not move far enough to impact the overspeed switch. The same control strategy represented in FIG. 5 works to avoid an undesired emergency stop otherwise caused by the APB.

The drive 30 is configured to recognize an APB condition based upon information regarding operation of the machine 26. In some embodiments, the drive 30 uses information from the output of the sensor 36, such as the encoder, to detect bouncing or vertical oscillations of the elevator car 22. Other sensors whose outputs are correlated with car motion behavior can be utilized to provide the needed information.

Figure 6:
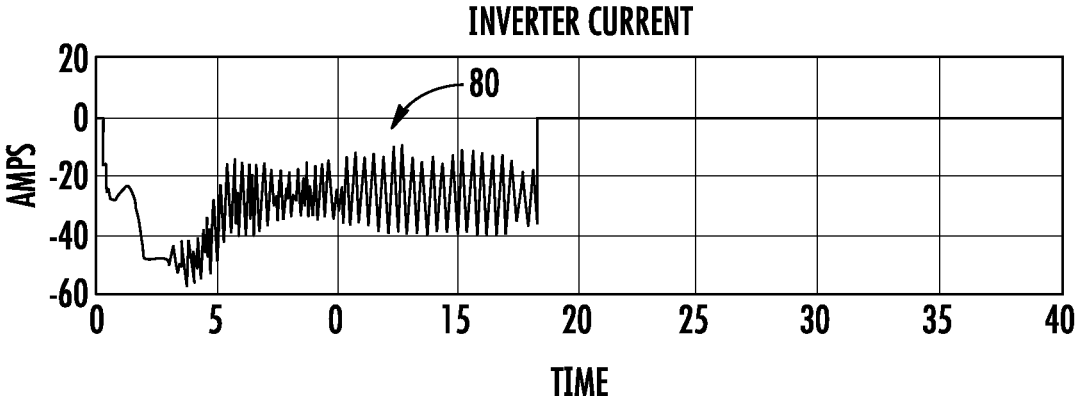
FIG. 6 illustrates a current associated with operation of an elevator machine during an APB condition.

In other embodiments, the drive 30 utilizes information regarding current associated with the inverter 34, for example, to detect bouncing or oscillation of the elevator car 22. FIG. 6 illustrates a current trace 80 corresponding to the current trace 44 of FIG. 3 except that FIG. 6 illustrates the current during an APB condition. As can be appreciated by comparing FIGS. 3 and 6, the current of the inverter 34 is noticeably different at 80 in FIG. 6 compared to the current at 40 in FIG. 3. For example, the current amplitude, frequency or periodic transient current peaks are different under normal operation compared to an APB situation. The drive 30 is configured to recognize such a difference from the expected current profile 44 associated with a normal elevator run as an indication of an APB condition requiring altering movement of the elevator car 22 to avoid adverse consequences associated with the APB condition. As explained above, the drive 30 may reduce the elevator car speed from the intended speed 42 to a lower speed 70 to avoid activating the governor 38 in a way that would instigate an emergency stop of the elevator car 22.

In some embodiments, the drive 30 is configured to use a combination of information regarding the current associated with the inverter 34 and the output of the encoder 42 for determining when an APB condition exists.

The example elevator system 20 includes an indicator 90 in the elevator car 22 to provide an indication to passengers during or regarding an APB condition. For example, the indicator 90 provides an indication that the elevator car 22 is intentionally moving slower, which may address any concerns of a passenger noticing that the elevator car 22 has slowed down. In another example, the indicator 90 provides an indication to stop the behavior that is causing the APB condition. For example, the indicator 90 may flash a warning and provide an audible message that says stop bouncing the elevator car to deter further inappropriate behavior, such as jumping or bouncing, within the elevator car 22. The indicator 90 in some embodiments provides a warning that authorities are being notified of the behavior and that continued inappropriate behavior could result in potential entrapment in the elevator car 22.

In some embodiments, the indicator 90 is provided on the car operating panel within the elevator car 22. In other embodiments, the indicator 90 comprises a display screen within the elevator car 22.

The illustrated example includes a camera 92 inside the elevator car 22. During APB conditions the camera 92 obtains an image or video of any passenger engaging in the APB for reporting information to appropriate authorities regarding the incident.

Embodiments of this invention provide the ability to avoid adverse consequences associated with APB conditions, such as those that may occur when a passenger jumps or bounces within an elevator car. By being able to address such situations, embodiments of this invention avoid unnecessary and undesirable emergency stop situations, which enhances more consistent elevator service availability and avoids costs associated with rescuing trapped passengers and returning elevator cars back to normal operation after an emergency stop.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator system, comprising:

an elevator car;

a machine that selectively causes movement of the elevator car; and a drive that controls the machine to control movement of the elevator car at an intended elevator car speed, the drive being configured to use information regarding operation of the machine to determine whether an abnormal passenger behavior (APB) condition exists that affects movement of the elevator car, the drive being configured to alter the elevator car speed when the APB condition exists, wherein the information regarding operation of the machine comprises information regarding an electrical current of the machine.

2. The elevator system of claim 1, comprising an inverter associated with at least one of the drive and the machine; and wherein the information regarding the electrical current of the machine comprises a difference between an expected electrical current and an actual electrical current associated with the inverter.

3. The elevator system of claim 2, wherein the difference between the expected electrical current and the actual electrical current comprises a difference in at least one of a frequency of the current, an amplitude of the current, and periodic transient current peaks.

4. The elevator system of claim 1, comprising at least one sensor that provides an indication of a speed of movement of the elevator car, and wherein the information regarding operation of the machine comprises an output of the at least one sensor.

5. The elevator system of claim 4, wherein the at least one sensor comprises an encoder associated with the machine.

6. The elevator system of claim 4, wherein the drive is configured to use the output of the at least one sensor to determine whether the APB condition exists; and the drive is configured to use the output of the at least one sensor to control operation of the machine to achieve the intended elevator car speed when the APB condition does not exist.

7. The elevator system of claim 1, wherein the APB condition includes passenger movement of at least a portion of a body of at least one passenger in the elevator car that causes oscillations of the elevator car in a vertical direction; and the passenger movement comprises at least one of bouncing or jumping.

8. The elevator system of claim 1, wherein the APB condition affects movement of the elevator car by at least temporarily causing the elevator car to move at an increased speed that exceeds the intended elevator car speed; and the drive is configured to alter the elevator car speed by reducing the elevator car speed below the intended elevator car speed.

9. The elevator system of claim 8, wherein the drive is configured to reduce the elevator car speed by reducing the elevator car speed by a first amount from the intended elevator car speed; and if the APB condition affects movement of the elevator car after reducing the elevator car speed by the first amount, reduce the elevator car speed further by a second amount.

10. The elevator system of claim 8, comprising a governor that is configured to instigate stopping the elevator car if the elevator car moves at a speed that exceeds a preselected threshold, and wherein the drive is configured to determine when the APB condition includes causing the elevator car to move at a speed that approaches the preselected threshold, and reduce the elevator car speed before the APB condition includes causing the elevator car to move at a speed that reaches or exceeds the preselected threshold.

11. The elevator system of claim 1, comprising a governor that is configured to instigate stopping the elevator car if the elevator car moves at a speed that exceeds a preselected threshold, and wherein the governor includes a centrifugal mechanism that moves in a manner that instigates stopping the elevator car;

the APB is effective to cause movement of the centrifugal mechanism in the manner that instigates stopping the elevator car even though the elevator car speed does not exceed the preselected threshold; and the drive is configured to alter the speed of the elevator car to prevent the movement of the centrifugal mechanism from instigating stopping the elevator car.

12. The elevator system of claim 1, comprising an indicator in the elevator car, the indicator being configured to provide at least one of an indication that the elevator car is moving at less than the intended elevator speed, an indication to stop the APB, an indication that authorities will be notified of the APB, and an indication that continuing the APB could result in being trapped in the elevator car.

13. The elevator system of claim 1, comprising a camera in the elevator car and wherein the camera captures at least one image of any passenger in the elevator car during the APB.

14. A method of controlling movement of an elevator car, the method comprising:

controlling a machine to control movement of the elevator car at an intended elevator car speed;

determining whether an abnormal passenger behavior (APB) condition exists that affects movement of the elevator car, based upon information regarding operation of the machine, wherein the information regarding operation of the machine comprises information regarding an electrical current of the machine; and altering the elevator car speed when the APB condition exists.

15. The method of claim 14, wherein the information regarding the electrical current of the machine comprises a difference between an expected electrical current and an actual electrical current associated with an inverter associated with the machine.

16. The method of claim 15, wherein the difference between the expected electrical current and the actual electrical current comprises a difference in at least one of a frequency of the current, an amplitude of the current, and periodic transient current peaks.

17. The method of claim 14, comprising determining the information regarding operation of the machine based on an output of at least one sensor that provides an indication of a speed of movement of the elevator car.

18. The method of claim 14, wherein the APB condition includes passenger movement of at least a portion of a body of at least one passenger in the elevator car that causes oscillations of the elevator car in a vertical direction; and the passenger movement comprises at least one of bouncing or jumping.

19. The method of claim 14, wherein the APB condition affects movement of the elevator car by at least temporarily causing the elevator car to move at an increased speed that exceeds the intended elevator car speed and the method comprises altering the elevator car speed by reducing the elevator car speed below the intended elevator car speed.

20. The method of claim 19, wherein reducing the elevator car speed comprises reducing the elevator car speed by a first amount from the intended elevator car speed; and if the APB condition affects movement of the elevator car after reducing the elevator car speed by the first amount, reducing the elevator car speed further by a second amount.

21. The method of claim 19, comprising determining when the APB condition includes causing the elevator car to move at a speed that approaches a preselected threshold of a governor that is configured to instigate stopping the elevator car if the elevator car moves at a speed that exceeds the preselected threshold, and reducing the elevator car speed before the APB condition includes causing the elevator car to move at a speed that reaches or exceeds the preselected threshold.

22. The method of claim 14, wherein the APB is effective to cause movement of a centrifugal mechanism of a governor in the manner that instigates stopping the elevator car even though the elevator car speed does not exceed a preselected threshold of the governor and the method comprises altering the speed of the elevator car to prevent the movement of the centrifugal mechanism from instigating stopping the elevator car.

23. The method of claim 14, comprising providing at least one of an indication that the elevator car is moving at less than the intended elevator speed, an indication to stop the APB, an indication that authorities will be notified of the APB, and an indication that continuing the APB could result in being trapped in the elevator car.

24. The method of claim 14, comprising obtaining at least one image of any passenger in the elevator car during the APB.

25. An elevator system, comprising:

an elevator car;

a machine that selectively causes movement of the elevator car; and a drive that controls the machine to control movement of the elevator car at an intended elevator car speed, the drive being configured to use information regarding operation of the machine to determine whether an abnormal passenger behavior (APB) condition exists that affects movement of the elevator car, the drive being configured to alter the elevator car speed when the APB condition exists, wherein the APB condition affects movement of the elevator car by at least temporarily causing the elevator car to move at an increased speed that exceeds the intended elevator car speed;

the drive is configured to alter the elevator car speed by reducing the elevator car speed below the intended elevator car speed by a first amount; and if the APB condition affects movement of the elevator car after reducing the elevator car speed by the first amount, reduce the elevator car speed further by a second amount.

26. An elevator system, comprising:

an elevator car;

a machine that selectively causes movement of the elevator car;

a drive that controls the machine to control movement of the elevator car at an intended elevator car speed, the drive being configured to use information regarding operation of the machine to determine whether an abnormal passenger behavior (APB) condition exists that affects movement of the elevator car, the drive being configured to alter the elevator car speed when the APB condition exists; and a governor that is configured to instigate stopping the elevator car if the elevator car moves at a speed that exceeds a preselected threshold, wherein the governor includes a centrifugal mechanism that moves in a manner that instigates stopping the elevator car;

the APB is effective to cause movement of the centrifugal mechanism in the manner that instigates stopping the elevator car even though the elevator car speed does not exceed the preselected threshold; and the drive is configured to alter the speed of the elevator car to prevent the movement of the centrifugal mechanism from instigating stopping the elevator car.

27. A method of controlling movement of an elevator car, the method comprising:

controlling a machine to control movement of the elevator car at an intended elevator car speed;

determining, based upon information regarding operation of the machine, whether an abnormal passenger behavior (APB) condition exists that affects movement of the elevator car by at least temporarily causing the elevator car to move at an increased speed that exceeds the intended elevator car speed; and altering the elevator car speed when the APB condition exists by reducing the elevator car speed below the intended elevator car speed including reducing the elevator car speed by a first amount from the intended elevator car speed and, if the APB condition affects movement of the elevator car after reducing the elevator car speed by the first amount, reducing the elevator car speed further by a second amount.

28. A method of controlling movement of an elevator car, the method comprising:

controlling a machine to control movement of the elevator car at an intended elevator car speed;

determining, based upon information regarding operation of the machine, whether an abnormal passenger behavior (APB) condition exists that affects movement of the elevator car by at least temporarily causing the elevator car to move at an increased speed that exceeds the intended elevator car speed;

determining when the APB condition includes causing the elevator car to move at a speed that approaches a preselected threshold of a governor that is configured to instigate stopping the elevator car if the elevator car moves at a speed that exceeds the preselected threshold; and altering the elevator car speed when the APB condition exists by reducing the elevator car speed before the APB condition includes causing the elevator car to move at a speed that reaches or exceeds the preselected threshold.

* * * * *